US006314954B1

(12) United States Patent
Wang

(10) Patent No.: US 6,314,954 B1
(45) Date of Patent: Nov. 13, 2001

(54) TOY GUN FOR FIRING PAINT BULLETS

(76) Inventor: Chu-Tou Wang, No. 56, Min Sheng Street, Feng-Yuan City (TW), 42041

( * ) Notice: Subject to any disclaimer, the term of this patent is extended or adjusted under 35 U.S.C. 154(b) by 0 days.

(21) Appl. No.: 09/570,739

(22) Filed: May 13, 2000

(51) Int. Cl.[7] ..... F41B 11/06
(52) U.S. Cl. ..... 124/74; 124/75
(58) Field of Search ..... 124/63, 64, 65, 124/73, 74, 75

(56) References Cited

U.S. PATENT DOCUMENTS

| | | | |
|---|---|---|---|
| 3,494,344 | 2/1970 | Vadas et al. | 124/74 |
| 4,819,610 | 4/1989 | Lacam et al. | 124/74 X |
| 5,429,108 | 7/1995 | Hsieh | 124/63 X |
| 5,823,173 | 10/1998 | Slonaker et al. | 124/74 X |
| 6,026,797 | 2/2000 | Maeda et al. | 124/74 |

*Primary Examiner*—Robert P. Swiatek

(57) ABSTRACT

A toy gun for firing paint bullet includes a casing symmetrically combined with first and second halves, a chamber in a rear portion for placing a mini-gas can, a barrel having a tubular loader in a front portion, a tubular shaft seat including a hollow shaft and a stinger disposed between the mini-gas can and the barrel, a trigger operating a rotor to actuate the shaft and the stinger to pierce the front end of the mini-gas can to provide suitable air pressure to fire the paint bullet inside the barrel and a safety catch controlling the trigger from accidental operation. The mini-gas can is readily replaceable in order to provide great convenience to the user.

4 Claims, 7 Drawing Sheets

TOY GUN FOR FIRING PAINT BULLETS

BACKGROUND OF THE INVENTION

The present invention relates to toy guns and more particularly to a toy gun for firing the paint bullets which toy gun is characterized in the rapid changing of its air pressure container and provides suitable air pressure to the gun for firing a paint bullet.

In a battle game, the teenagers use the toy guns to shoot each other with the paint bullets in order to obtain a great fun among them. These toy guns include pistol, rifle and/or machinegun for a single firing or continuous firing of the paint bullets by using the air pressure from a gas or pneumatic container. However, they have the common disadvantage that the air pressure is supplied by an external pneumatic source so that the teenagers have to carry a heavy gas container on their shoulders, causing a great burden and inconvenience to them.

SUMMARY OF THE PRESENT INVENTION

The present invention has a main object to provide a structurally improved toy gun for firing a paint bullet which includes a chamber in a rear side to enable the gun to carry a mini-gas can itself for providing suitable air pressure to fire a paint bullet. The mini-gas can is readily replaceable so as to provide great convenience to the user.

Another object of the present invention is to provide a structurally improved toy gun for firing a paint bullet which is readily to assemble or disassemble.

Further object of the present invention is to provide a structurally improved toy gun for firing a paint bullet in which a safety device is provided to prevent the gun from being inadvertently triggered.

The present invention will become more fully understood by reference to the following detailed description thereof when read in conjunction with the attached drawings.

DETAILED DESCRIPTION OF THE PREFERRED EMBODIMENT

Figure 1:
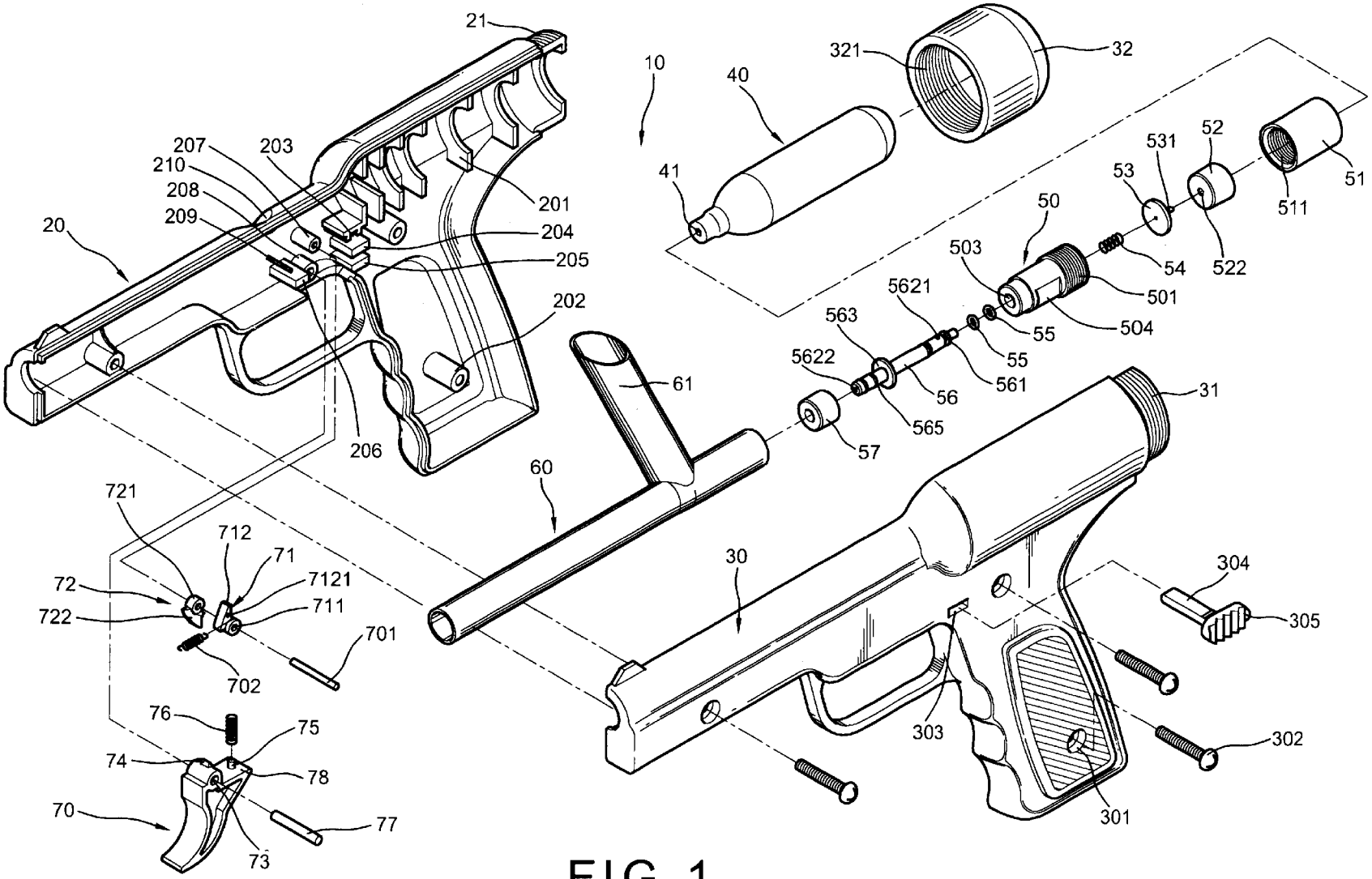
FIG. 1 is an exploded perspective view to show a preferred embodiment of a toy gun according to the present invention.
Figure 2:
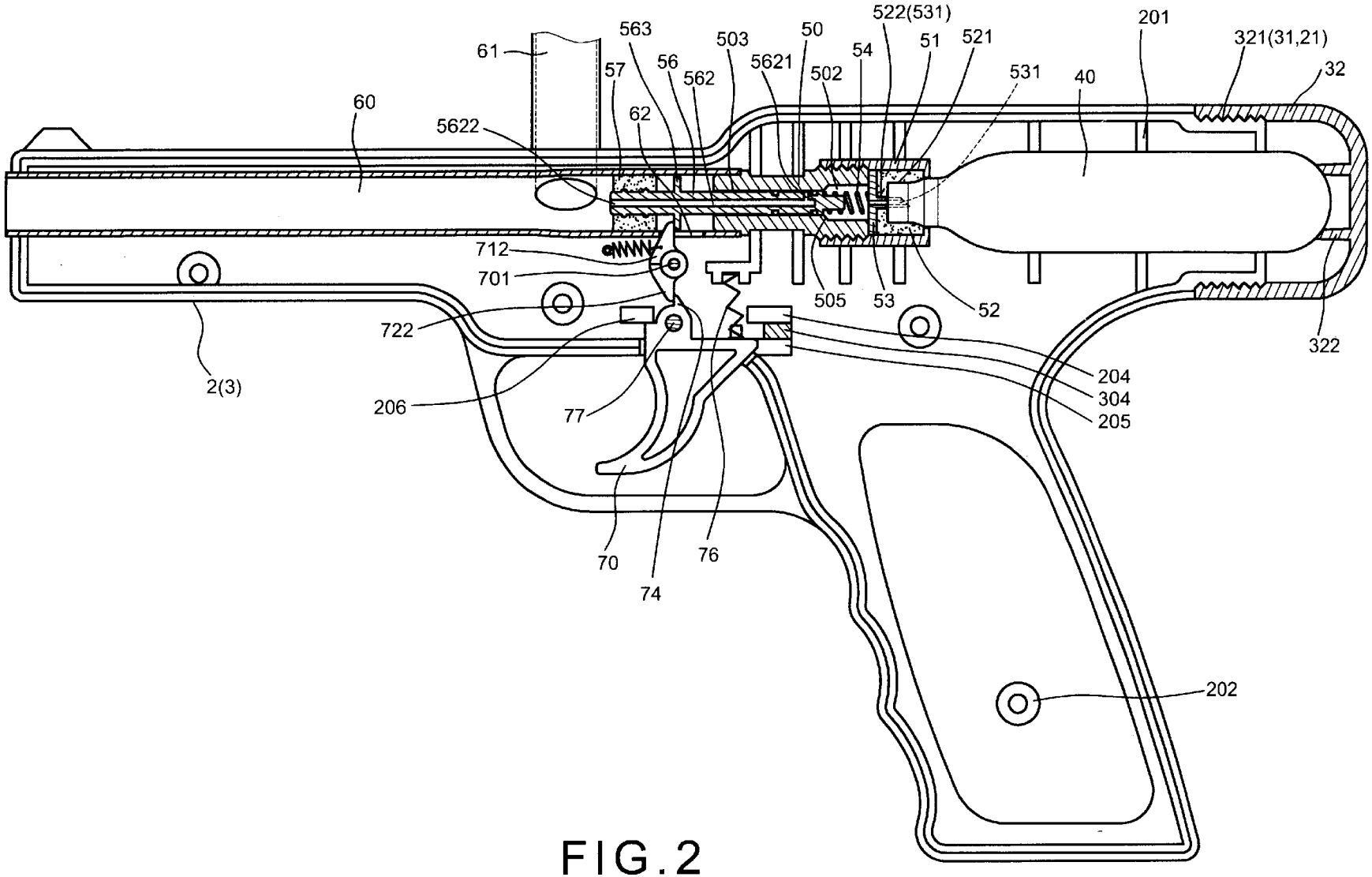
FIG. 2 is a side view to show an assembly of FIG. 1.
Figure 3:
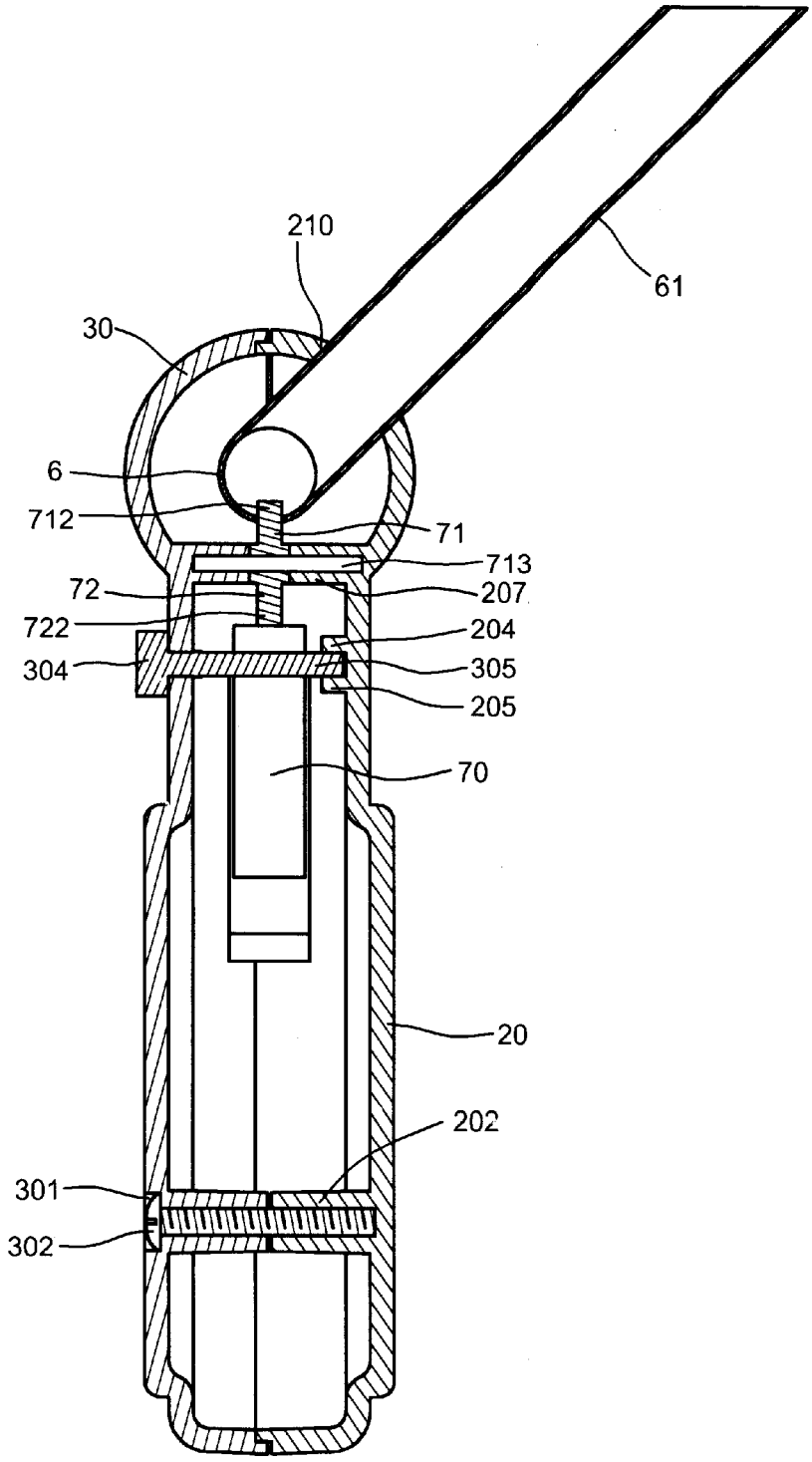
FIG. 3 is a transverse cross section of FIG. 2.

With reference to FIGS. 1, 2 and 3 of the drawings, the toy gun of the preferred embodiment according to the present invention comprises a casing 10 symmetrically combined with first and a second halves 20 and 30 each having a plurality of semi-circular ribs 201 formed spaced apart in a rear portion to define a tubular chamber therebetween and a narrowed, threaded outer periphery 21 and 31 on the rear end.

The first half 20 further has a plurality of protrudent screw holes 202, a grooved plate 203, an upper positioning plate 204, a lower positioning plate 205, a check plate 206, an upper pivot 207, a lower pivot 208, a protrudent rod 209 and an access 210.

The second half 30 further has a plurality of screw holes 301 made in registry with the protrudent screw holes 202 of the first half 20 for coupling the two halves 20 and 30 together with screws 302. A safety catch 304 slidably engaged into the gap between the upper and lower positioning plates 204 and 205 of the first half 20 through a rectangular recess 303 includes a thumbplate 305 on outside of the casing 10.

A cap 32 covers the rear end of the casing 10 and has a threaded inner periphery 321 engageable with the threaded outer periphery 21 and 31 of the casing 10 and a plurality of pinch plates 322 centrally projected forward from the inner wall of the end (as shown in FIG. 2).

A mini-gas can 40 is inserted into the chamber in the rear portion of the casing 10 and is stopped on rear end against the pinch plate 322 of the cap 32 and has a sealed air outlet 41 in a reduced front end. The mini-gas can 40 which is replaceable from the casing 10 and contained with the carbon dioxide gas, now is available on the market.

A sleeve 51 sleeves on the front end of the mini-gas can 40 and has a threaded inner periphery 511 abutting the front thereof and a reduced opening in rear end tightly engaged with the front end of the mini-gas can 40.

A bushing 52 which is made of flexible plastic disposes in the rear portion of the sleeve 51 and tightly wraps on the front end of the mini-gas can 40 and has a small central bore 522 in front end communicating with the sealed air outlet 41 of the can 40.

A circular stinger seat 53 disposes on the outer end of the bushing 52 and a stinger 531 pierces into the sealed air outlet 41 of the mini-gas can through the small control bore 522 of the bushing 52.

A tubular shaft seat 50 is fastened to the sleeve 51 and has a threaded outer periphery 501 on rear end engageable with the threaded inner periphery 511 of the sleeve 51, a large central bore 502 communicating with small central bore 503 so as to define a shoulder 505 therebetween and a pair of concave portions 504 symmetrically formed on opposing outer peripheries engageable with the semi-circular ribs 201 of the first half 20.

A hollow shaft 56 inserts into the shaft seat 50 and is biased by a spring 54 on rear end thereof and has a shoulder 561 stopped against a front end of the spring 54, a narrow central bore 562 to define an air inlet 5621 and an air outlet 5622 respectively at two ends, a flange 563 on front portion and pair of annular-rings spacedly formed on an outer periphery between the air outlet 5622 and the flange 563 for flexibly engaged with a bushing 57 which is also made of flexible plastic has a central bore in a front end, and a pair of sealing rings 55 spacedly secure on an outer periphery abutting the rear end thereof.

A barrel 60 disposes into the front portion of the casing 10 with its rear end engaged with the front end of the shaft seat 50 has a tubular loader 61 perpendicularly with the body and inserted outward through the access 210 of the first half 20 and a rectangular hole 62 in an underside.

A trigger 70 rotatably pivots to a pivot 208 of the first half 20 and has a retaining ring 73 on a top engageable with the pivot 208 and secured with a pin 77, a projection 74 on the top of the retaining ring 73, an angled portion under the retaining ring 73 stopped against a bottom of the check plate 206, a small post 75 projected upward from a flat surface 78 on a top of the trigger 70 and a spring 76 having a lower end sleeved on the small post 75 and an upper end engaged into the grooved plat 203 of the first half 20.

A rotor includes an upper portion 71 and a lower portion 72 each having a retaining ring 711 and 721 respectively and rotatably secured to the pivot 207 with a pin 701 and a roughly triangular plate 712 and 722 engageable with each other. The triangular plate 712 has retaining hole 7121 for retaining one end of a spring 702 which has on the other end retained to the protrudent rod 209 of the first half 20 and a top stopped against the flange 563 of the shaft 50 through the rectangular hole 62 of the barrel 60. The triangular plate 722 has a lower end stops against the projection 74 of the trigger 70.

Figure 4:
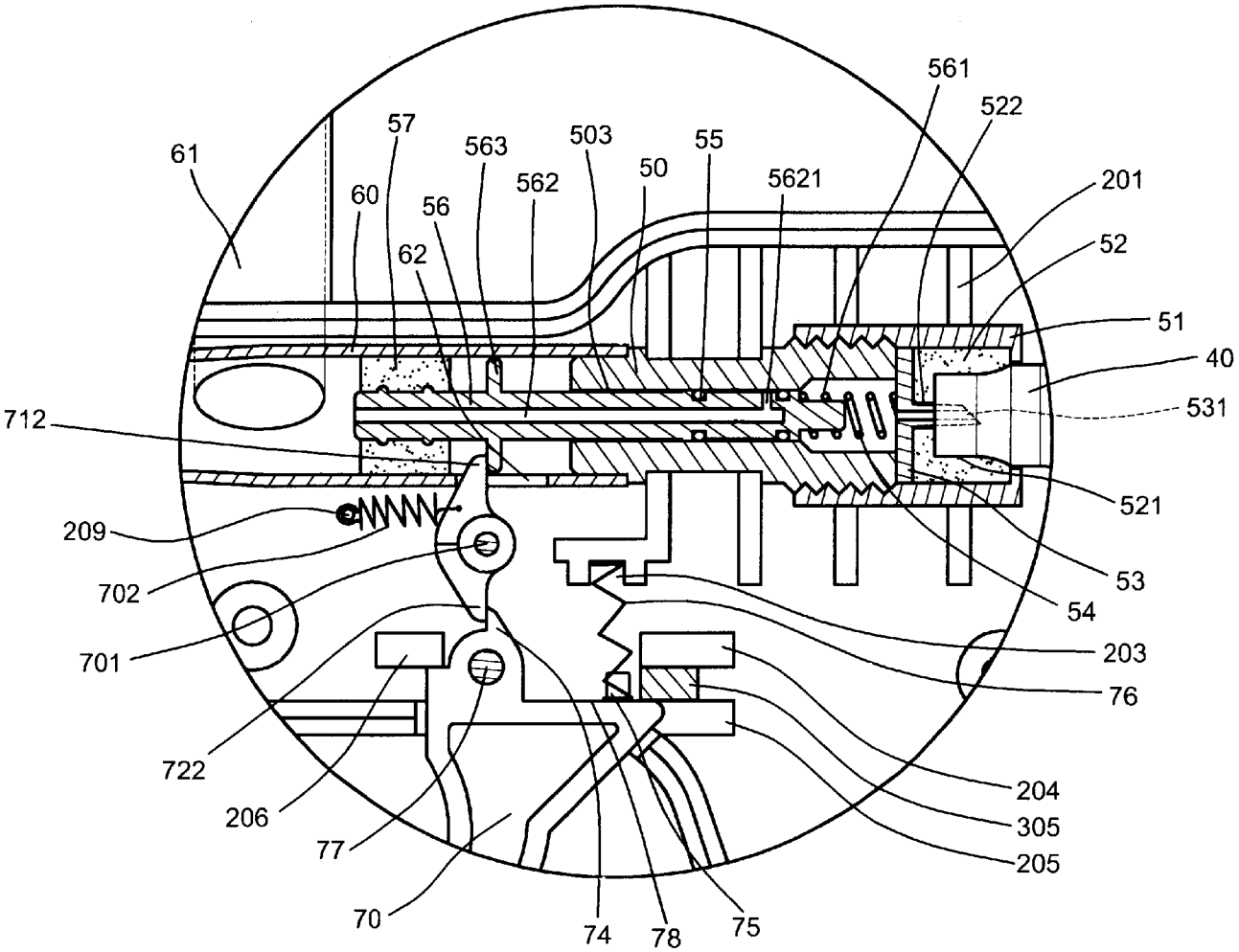
FIG. 4 is a sectional view of FIG. 2 showing that the catch plate is moving forward.
Figure 5:
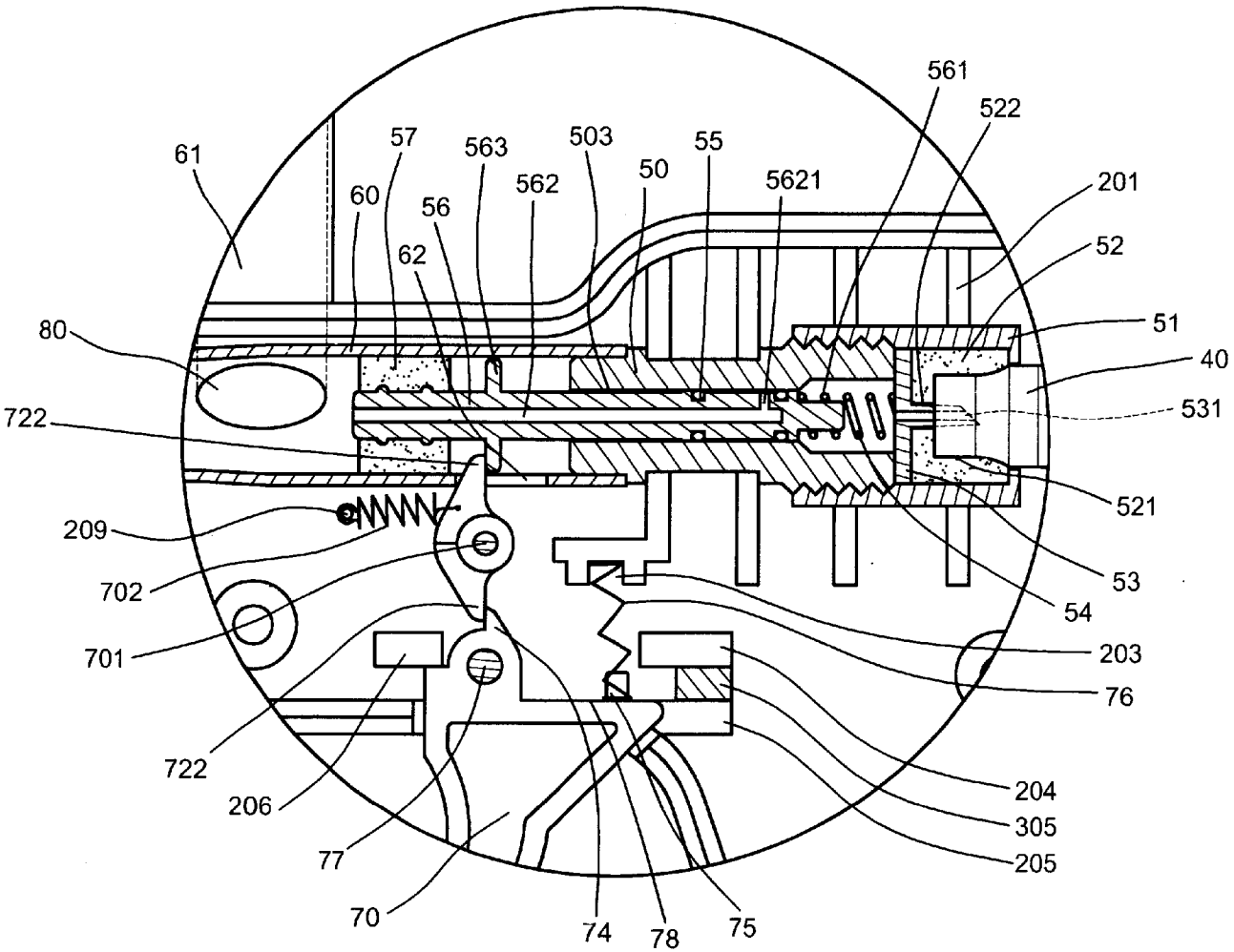
FIG. 5 is a sectional view of FIG. 2 showing that the catch plate is moving backward.
Figure 7:
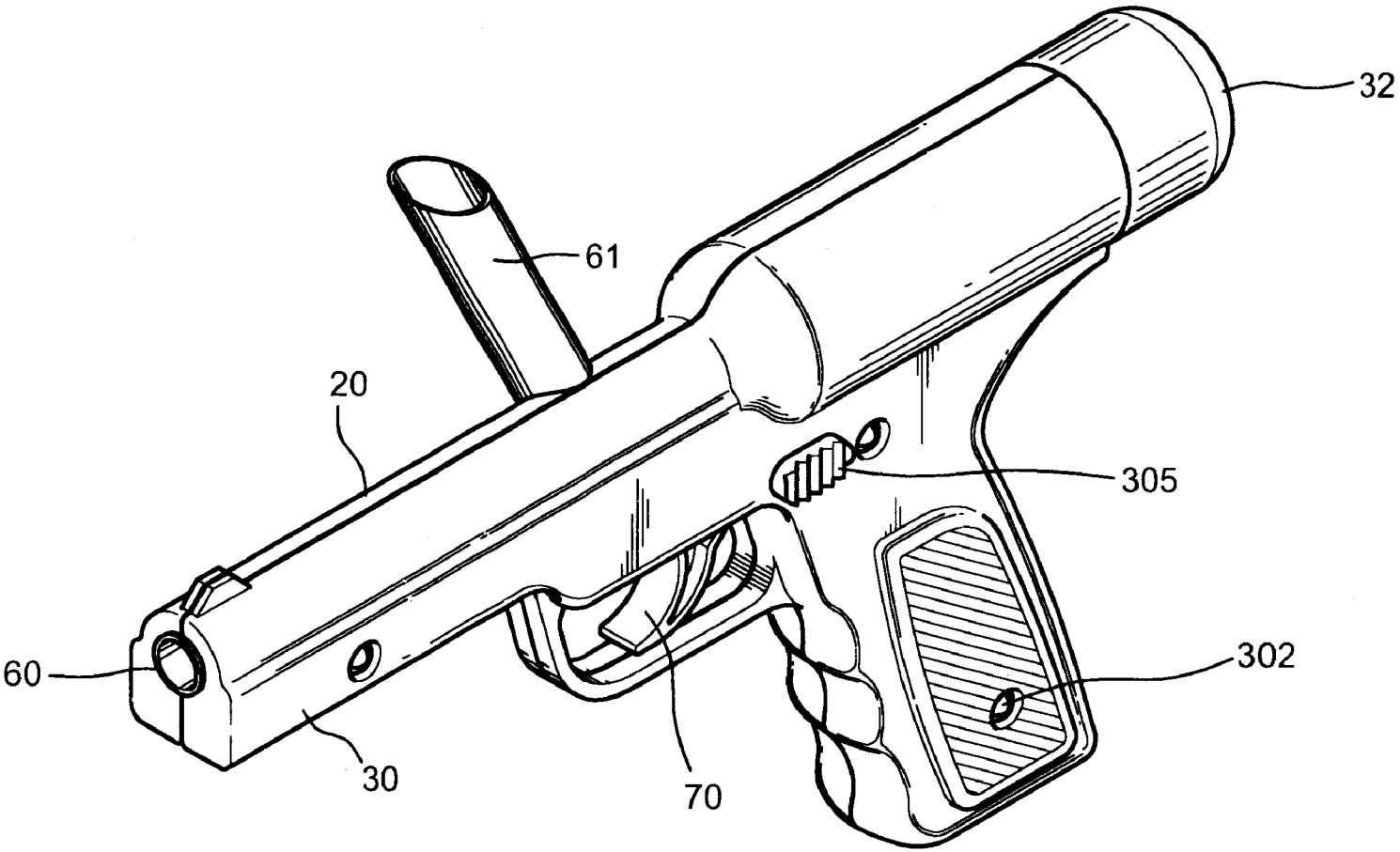
FIG. 7 is a perspective view to show an outlook of the toy gun according to the present invention.

When assembling, it is known to first assemble all components as described above into the first half 20 of the casing 10 except the mini-gas can 40 and the cap 32, then combine the second half 30 with the first half 20 with screws 302 and then slidably engage the safety catch 304 into the gap between the positioning plates 204 and 205 through the rectangular recess 303. When the safety catch 304 is slid forward (as shown in FIG. 4), its bottom stops against the flat surface 78 of the trigger 70 so that the trigger is locked from any movement and when it moves backward and leaves the flat surface 78, the trigger 70 becomes operable (as shown in FIG. 5). FIG. 7 shows an outlook of an assembled toy gun of the preferred embodiment according to the present invention.

Figure 6:
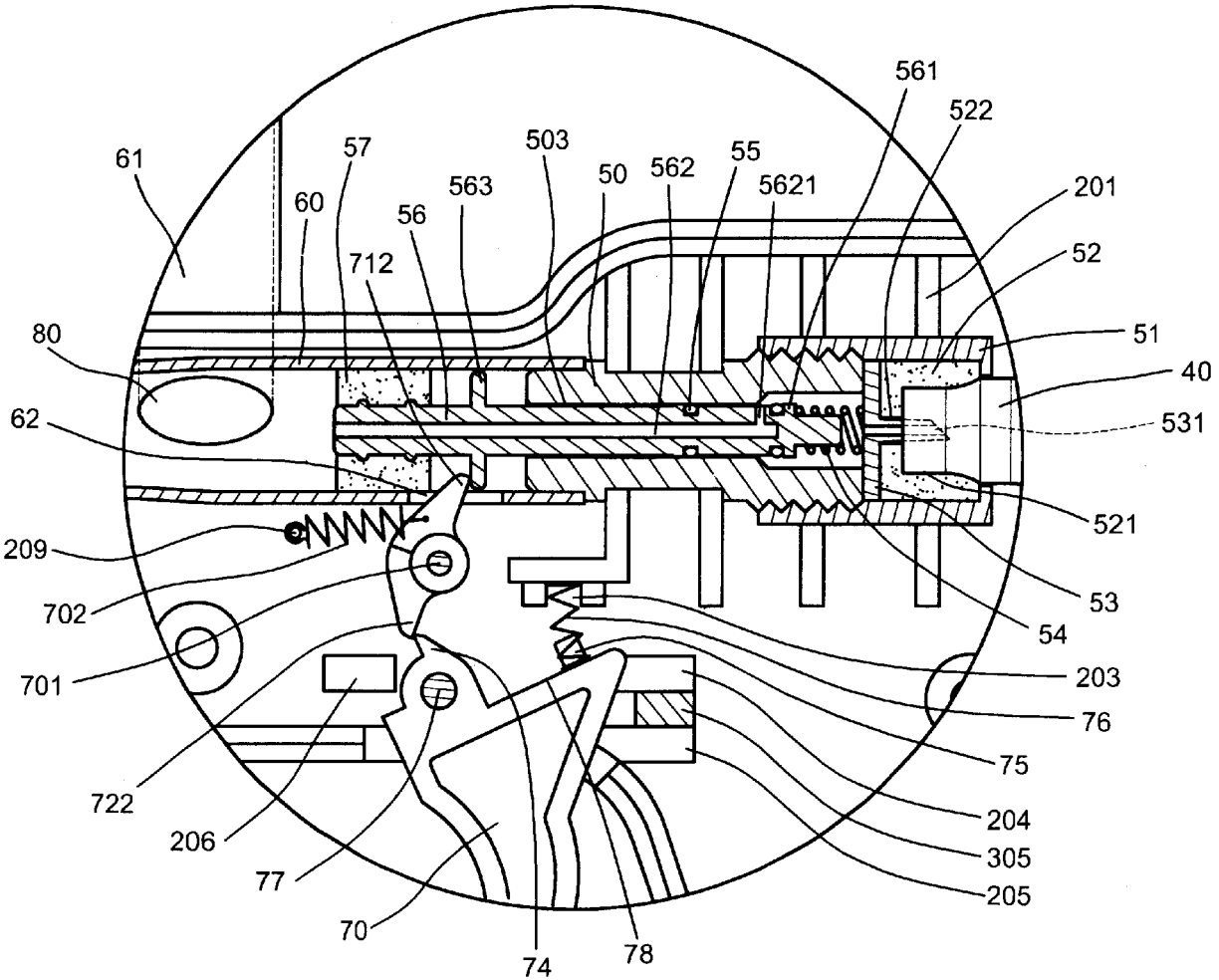
FIG. 6 is a sectional view of FIG. 2 showing that the gun is triggered.

Referring to FIG. 6, when the safety catch 305 is positioned at a forward position (as shown in FIG. 4), insert a mini-gas can 40 into the chamber in rear end of the casing 10 and fasten the cap 32 on the rear end so that the rear end of can 40 is secured by the pinch plates 322 of the cap 32, then load a certain number of the paint bullets 80 into the loader 61, the bullets will enter into the barrel on one by one basis, and then slide the safety catch backward (as shown FIG. 5); the gun is therefore ready to fire.

When shooting, press the trigger 70 backward, the triangular plate 722 of the lower portion 72 of rotor is actuated by the projection 74 of the trigger 70 to operate the triangular plate 712 of the upper portion 71 of the rotor to rotate clockwise so as to push the flange 563 of the tubular shaft 56 to move rearward so that the read end of the shaft 56 pushes the stinger seat 53 via the spring 54 to move rearward, too. The stinger 531 pierces into the sealed air outlet of the mini-gas can 40 from which a suitable amount of the air pressure puffs out through the stinger seat 53 and the narrow central bore 562 of the shaft 56 to shoot a paint bullet 80 out of the barrel 60. When the trigger 70 is released, it will be immediately returned to the original position because of the resilience of the spring 76, and the triangular plate 712 of the rotor is also returned to its original position because of the spring 702. If one presses the trigger 70 repeatedly, the toy gun will be operated repeatedly as described above to fire a certain number of the paint bullets 80. Since the bullets 80 are reloaded and the mini-gas can 40 is replaceable, the toy gun of the present invention is rather more convenient than the prior art toy guns.

Note that the specification relating to the above embodiment should be construed as exemplary rather than as limitative of the present invention, with many variations and modifications being readily attainable by a person of average skill in the art without departing from the sprit or scope thereof as defined by the appended claims and their legal equivalents.

I claim:

1. A toy gun for firing paint bullets comprising:

a casing symmetrically combined with a first and a second half, each having a front portion, a rear portion, a plurality of semi-circular ribs formed spaced apart in the rear portion to define a tubular chamber therebetween and a first threaded outer periphery on a reduced rear end thereof;

said first half further having a plurality of protrudent screw holes spacedly formed on inner side, a grooved plate, an upper positioning plate and a lower positioning plate to define a gap therebetween, a check plate, an upper pivot, a lower pivot protrudent rod, and a recess formed in an upper periphery;

said second half further having a plurality of screw holes formed in registry with the protrudent screw holes for combining the second half with the first half by screws and a rectangular recess in a periphery made in registry with the gap-inside said first half;

a mini-gas container disposed into the tubular chamber of the casing and having a sealed air outlet in a reduced front end;

a cap covering the reduced rear end of the casing and having a first threaded inner periphery engaged with the first threaded outer periphery of the casing and a plurality of pinch plates centrally projected forward from inner bottom for gripping a rear end of the mini-gas container;

a sleeve engaged on the reduced front end of the mini-gas container and having a second threaded inner periphery abutting a front end and a reduced opening in a rear end thereof;

a first bushing means disposed into the reduced opening of the sleeve and tightly wrapping on the reduced front end of the mini-gas container and having a first small central bore in a front end communicating with the sealed air outlet of the mini-gas container;

a circular stinger seat disposed on the front end of the first bushing means and having stinger pierceable into the sealed air outlet of the mini-gas container through the first small central bore of the first bushing means;

a tubular shaft seat engaged with the front end of the sleeve and having a second threaded outer periphery engaged with the second threaded inner periphery of the sleeve, a front end and a rear end, a large central bore in the rear end communicating with a second small central bore in the front end of the shaft seat to define a shoulder therebetween and a pair of concave portions symmetrically formed on opposing outer peripheries thereof engaged with the semi-circular ribs of the casing;

a hollow shaft inserting into the tubular shaft seat and having a reduced rear end biased by a first spring, a narrow central bore including an air inlet on an outer periphery adjacent the rear end and an air outlet in a center of a front end thereof, a flange formed on an outer periphery adjacent the front end, a pair of annular rings formed spaced apart between the air outlet and the flange for engaging with a second bushing means which has a third small central bore in a front end communicating with the air outlet of the shaft and a pair of sealing rings secured spaced apart adjacent the rear end thereof;

a barrel disposed in the front portion of the casing and having a rear end engaged with the front end of the tubular shaft seat and stopped against a front side of the flange of the shaft seat, a tubular loader perpendicularly connected with a rear peripheral wall and extended to outside the casing through the recess thereof and a rectangular hole in an underside adjacent the rear end thereof;

a rotor symmetrically combined with an upper portion and a lower portion end having a first retaining ring uniformly and rotatably secured to the upper pivot of the first half by a pin and a triangular plate connected to one side of the retaining ring, said triangular plate of the upper portion engaged with the flange of the hollow shaft through the rectangular hole of the barrel and having a retaining hole in one side for retaining one end of a second spring which has another end hooked on the protrudent rod of the first half;

a trigger having a second retaining ring rotatably secured to a lower pivot of the first half by a pin, a projection on a top of the second retaining ring engaged with the triangular plate of the lower portion of the rotor, an angled portion adjacent the second retaining ring engaged with the check plate of the first half, a flat surface on a top and a post projected upward from the flat surface for engaging a lower end of a third spring which has an upper end engaged into the grooved plate of the first half;

a safety catch having a catch slidably engaged into the gap between the upper and lower positioning plates of the first half through the rectangular recess of the second half and engageable with the flat surface of the trigger and having a thumbplate perpendicular to the catch positioned outside the second half.

2. The toy gun as recited in claim 1 wherein said bushing means are made of flexible plastic material.

3. The toy gun as recited in claim 1 wherein said mini-gas container contains carbon dioxide gas.

4. The toy gun as recited in claim 1 further having a plurality of paint bullets loaded in the tubular loader.

* * * * *